US005651633A

United States Patent [19]

Howe

[11] Patent Number: 5,651,633

[45] Date of Patent: Jul. 29, 1997

[54] TENT POLE FASTENER COMPRISING CLIP AND ATTACHED FLEXIBLE TIE

[76] Inventor: Robert H. Howe, 4285 Whittle Ave., Oakland, Calif. 94602

[21] Appl. No.: 425,656

[22] Filed: Apr. 20, 1995

[51] Int. Cl.[6] ..... F16B 2/22

[52] U.S. Cl. ..... 403/392; 403/396; 403/399; 403/400; 135/135; 24/300

[58] Field of Search ..... 403/397–400, 403/388, 392, 395, 396, 384, 24, 346; 24/300, 715.3; 135/135, 136, 147, 124, 125, 156

[56] References Cited

U.S. PATENT DOCUMENTS

| | | | |
|---|---|---|---|
| 960,849 | 7/1910 | Dilg . | |
| 2,454,464 | 11/1948 | Lee | 135/15 |
| 2,650,401 | 9/1953 | LaMond | 24/203 |
| 3,496,686 | 2/1970 | Bird | 52/2 |
| 4,099,533 | 7/1978 | Gillis | 135/125 |
| 4,265,259 | 5/1981 | Gillis | 135/1 R |
| 4,491,141 | 1/1985 | Eppenbach | 135/125 |
| 4,831,692 | 5/1989 | Chuan | 24/300 |
| 5,062,184 | 11/1991 | Rowland | 24/300 X |
| 5,067,505 | 11/1991 | Cantwell et al. | 135/125 |
| 5,197,504 | 3/1993 | Howe | 135/156 X |
| 5,317,788 | 6/1994 | Esposito et al. | 24/300 |
| 5,317,826 | 6/1994 | Underwood | 403/392 X |

FOREIGN PATENT DOCUMENTS

| | | | |
|---|---|---|---|
| 1166926 | 5/1984 | Canada | 135/156 |
| 2648852 | 12/1990 | France | 135/125 |
| 2319796 | 10/1974 | Germany | 135/125 |
| 3213781 A1 | 2/1983 | Germany . | |

*Primary Examiner*—Harry C. Kim
*Attorney, Agent, or Firm*—David Pressman

[57] ABSTRACT

A locking fastener includes a generally C-shaped body (10) with a slot (16) for holding a loop of webbing (18) extending from a tent membrane (17). The C-shaped body has an internal opening (11), and a gap (12) between the two ends for snapping around the intersection of two tent poles (19). An elastic cord (14) has one end attached to the C-shaped body, and a free portion for tightly wrapping around the intersection of the poles. An anchoring notch (15) on the C-shaped body receives the remaining free portion of the cord for anchoring it and maintaining it in tension. Thus the tent membrane is fastened to the poles, and the poles are locked together to prevent their intersecting point from shifting, so that in conjunction with additional poles and fasteners, the shape and structural integrity of the tent is maintained.

20 Claims, 3 Drawing Sheets

TENT POLE FASTENER COMPRISING CLIP AND ATTACHED FLEXIBLE TIE

BACKGROUND OF THE INVENTION

1. Field of the Invention

This invention relates generally to tents, specifically to a locking fastener for locking a pair of tent poles at their intersection, and suspending a tent membrane thereunder.

2. Prior Art

Camping or backpacking tents are small, portable shelters that generally include a dome shaped membrane. The membrane (made of canvas, nylon, etc.) is supported at its outer surface from a set of overhead, flexible, intersecting poles bent into arches. A series of rings or fasteners are distributed along the pole paths. The poles extend through the rings, which hold the membrane to the poles. When properly assembled, the membrane is stretched taut throughout its entire surface, the fasteners are positioned as far apart from each other as possible, and the poles intersect each other at predetermined points. However, the intersecting poles often shift position relative to each other, especially when the tent is assembled and positioned on uneven ground, so that some poles will move the fasteners closer together. This causes the membrane between those rings to slacken, and the tent to become deformed. When the tent is deformed, its structural integrity is reduced, and it may flap about in the wind, or even partially collapse.

Several different devices have been proposed for joining tent poles at their intersections to prevent them from shifting position, so as to maintain the shape of the tent. U.S. Pat. No. 4,265,259 to Gillis (1981) shows a device with a pair of pivoting sleeves 15, 17 attached to predetermined points on a tent membrane with discs. The pivoting sleeves hold two poles together at their intersection at any angle. However, the sleeves are free to slide along the poles if disturbed, so that the intersection points may shift and deform the tent.

German patent publication DE 3213-781 to Kramer (1983) shows a hook 26 closed with a flexible tab 30 for holding a pair of tent poles 12 at their intersection. A strip of webbing 36 connected to a tent membrane 14 is looped through a slot 34 on a lower part of the clip. The Kramer device is also free to slide along the poles, so that the intersection points between them may shift and deform the tent.

U.S. Pat. No. 2,650,401 to La Mond (1951) shows a clip similar to the Kramer device, but made for a different purpose. It is mounted to a sheet of canvas 12 by passing a strip of webbing 50 through a slot 20 thereon. A flap of canvas that includes a grommet 38 is folded over the clip, so that the clip is passed through the grommet. A rope 40 is pushed sideways into the clip to retain the grommet and the flap of canvas thereon. The La Mond device can be used for holding intersecting tent poles in the same manner as the Kramer device, and it suffers the same drawback.

OBJECTS OF THE INVENTION

Accordingly several objects of the present invention are to provide a tent with more structural integrity, to provide a tent with poles that are more resistant to shifting, to provide a tent that can be assembled and positioned on uneven ground with greater stability, and to provide a tent with membrane holders that resist shifting.

Other objects are to provide a locking fastener that can hold two intersecting tent poles securely enough to prevent their intersection point from shifting, so as to maintain the shape and structural integrity of the tent; to provide a locking fastener that can hold poles having a predetermined range of diameters together; to provide a locking fastener that can hold the poles at any intersection angle; to provide a locking fastener that can also hold a single pole; and to provide a locking fastener that is simple to manufacture. Further objects of the invention will become apparent from a consideration of the drawings and ensuing description.

SUMMARY OF THE INVENTION

These objects are achieved with a locking fastener having a C-shaped body with a slot on a bottom portion, an elastic cord extending from one end of the "C", and an anchoring notch on the vertical portion of the "C." The hook is attached to a tent membrane by passing a loop of webbing extending therefrom through the slot. The hook can be snapped around the intersection of two poles, and securely locked thereon by tightly wrapping the elastic cord around the poles one or more times, then anchoring the cord in the notch. The poles are thus held securely together, and their intersection point will not shift.

DRAWING REFERENCE NUMERALS

| | |
|---|---|
| 10. Body | 11. Internal Opening |
| 12. Gap | 13. Hole |
| 14. Elastic Cord | 15. Anchoring Notch |
| 16. Slot | 17. Tent Membrane |
| 18. Loop Of Webbing | 19. Tent Poles |

DESCRIPTION—FIG. 1—LOCKING FASTENER

Figure 1:
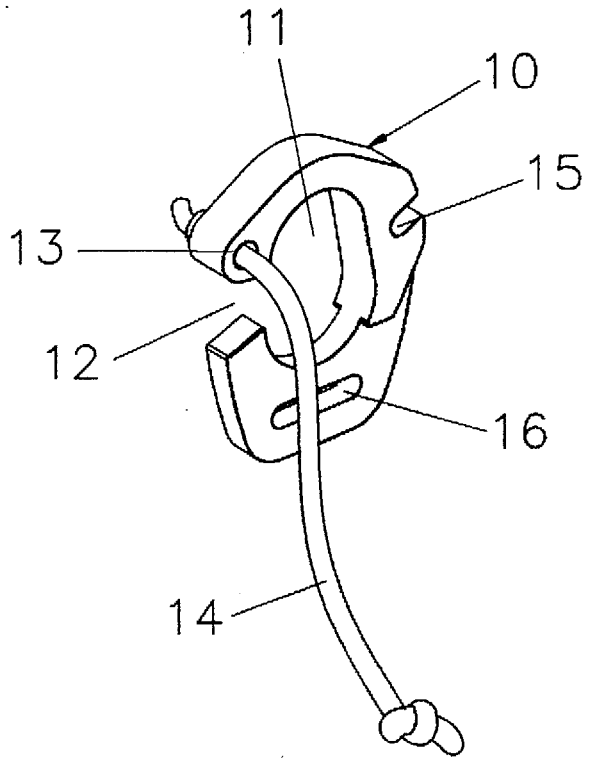
FIG. 1 is a front perspective view of a locking fastener in accordance with a preferred embodiment of the invention.

In accordance with a preferred embodiment of the invention shown in the front perspective view of FIG. 1, a locking fastener includes a generally C-shaped body 10 with an internal opening 11, a gap 12 between the ends of the "C", a hole 13 through the upper end of the "C" near gap 12, an elastic cord 14 positioned through hole 13, an anchoring notch 15 on the outside edge of the vertical portion of the "C", and a slot 16 on the bottom portion of the "C." The locking fastener is made of a flexible plastic, such as ABS or nylon. Cord 14 is made of high-friction neoprene tubing, and includes knotted ends to prevent it from coming out of hole 13.

INSTALLATION—FIG. 2

Figure 2:
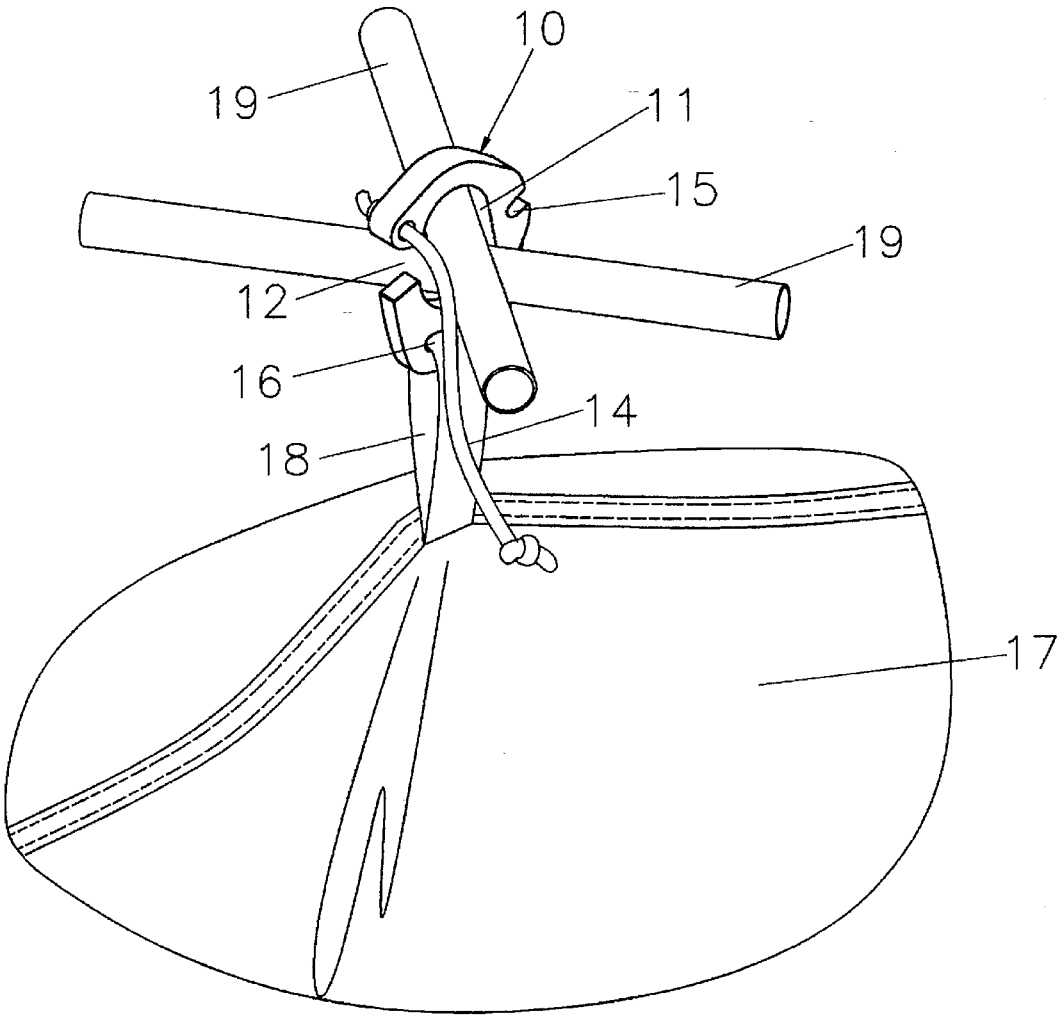
FIG. 2 is a front perspective view of the locking fastener when first attached to two intersecting poles.

The installation of the locking fastener is illustrated in FIG. 2. The locking fastener is permanently attached to a conventional tent canvas or membrane 17 as follows. A loop of conventional webbing 18 extends from membrane 17 and passes through slot 16. This is done when webbing 18 is sewn onto membrane 17 during the manufacturing process. Additional locking fasteners (not shown) are attached to membrane 17 along the projections of the poles thereon.

A set of tent poles 19 (two shown) are assembled with membrane 17 in the conventional manner: poles 19 are positioned along the intersecting paths defined by the locking fasteners, and their ends are inserted into conventional sockets (not shown) distributed around the edge of membrane 17. Each locking fastener is positioned at the intersection of two poles 19, which are snapped, one at a time, into internal opening 11 of flexible plastic body 10 through gap 12.

In this example, internal opening 11 is about 25 mm across at its maximum, and gap 12 is about 8 mm across, so that body 10 can hold two poles 19 with diameters of about 10 mm or less. Internal opening 11 is sized to leave enough free space around poles 19 to allow them to be positioned at any angle. The dimensions of body 10 can be adapted to accommodate other size poles, but in any embodiment, internal opening 11 should be greater than twice the diameter of a pole it is intended for, and gap 12 should be slightly smaller than the pole's diameter.

INSTALLATION—FIG. 3

Figure 3:
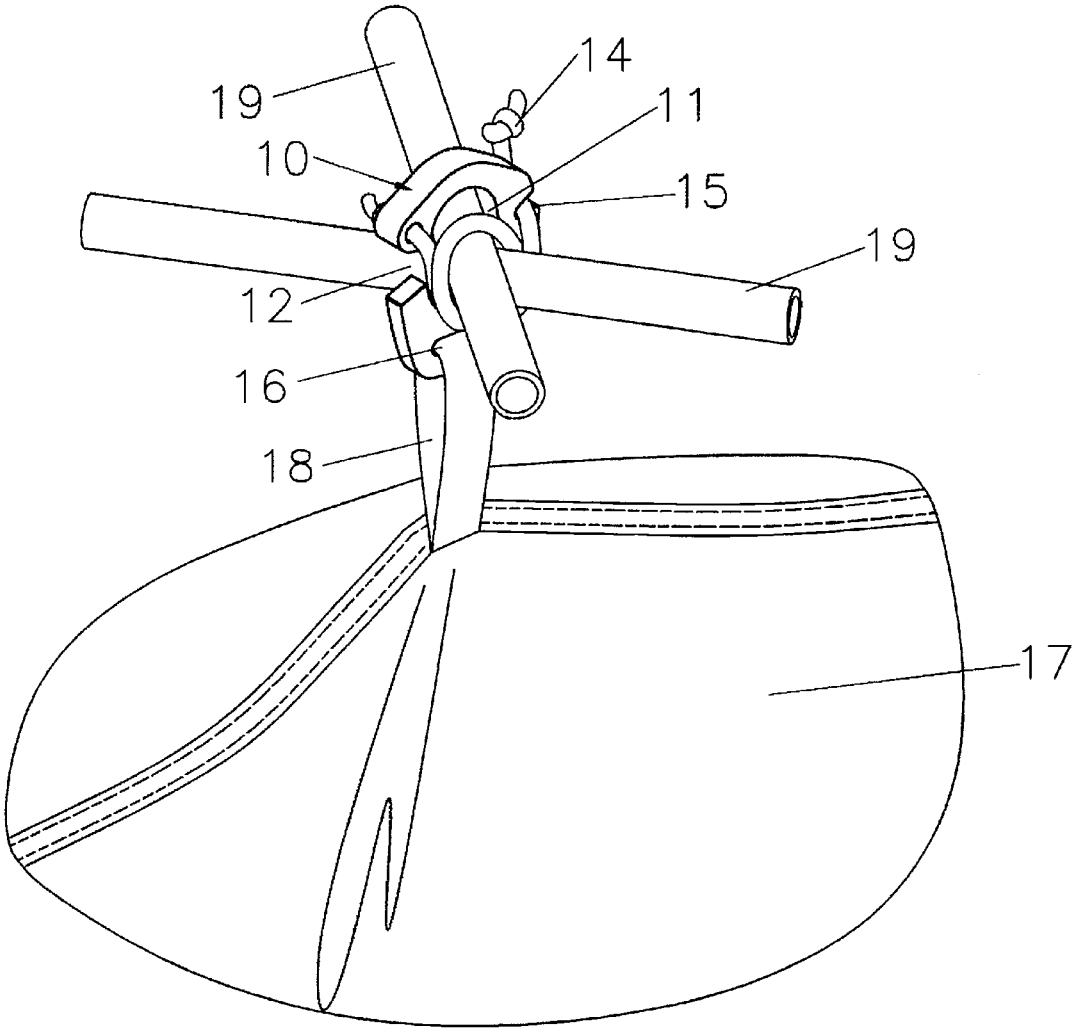
FIG. 3 is a front perspective view of the locking fastener locked around the poles.

When tent membrane 17 and poles 19 are erected, the intersection points of poles 19 are adjusted by sliding the locking fasteners (one shown) therealong and pulling membrane 17 with them, until membrane 17 is evenly stretched all around. When the locking fasteners are all properly positioned, elastic cord 14 is tightly wrapped around both poles 19 one or more times, and then wedged into anchoring notch 15 to maintain its tension, as shown in FIG. 3. For the part sizes given, cord 14 preferably is 15 cm long and 4 mm in diameter. Because cord 14 is made of a high-friction material, it positively locks poles 19 together and prevents their intersection point from shifting. The shape and structural integrity of the erected tent (partially shown) is thus maintained, even in strong wind and uneven ground. In any embodiment, cord 14 should be long enough to wrap around poles 19 up to about three times.

In addition to locking two intersecting poles, the fastener can also be used for holding and locking onto a single pole (not shown), such as between pole intersections. Cord 14 would be wrapped around the single pole and wedged in notch 15 in the same manner already described.

SUMMARY, RAMIFICATIONS AND SCOPE

Accordingly, the reader will see that I have provided a locking fastener that can securely hold two intersecting poles together, and prevent their intersection point from shifting, so as to maintain and increase the shape and structural integrity of the tent, especially on uneven ground. It can hold poles within a range of diameters at any intersection angle. It can be used for holding and locking onto a single pole. It is also very simple, so that it is very economical to manufacture.

Although the above descriptions are specific, they should not be considered as limitations on the scope of the invention, but only as examples of the embodiments. Many other ramifications and variations are possible within the teachings of the invention. For example, the dimensions of the fastener can be easily adapted for fitting poles of other diameters. Instead of having a slot holding a loop of webbing, the fastener can be attached to the tent membrane in other ways, such as with rivets. Instead of a permanent attachment, the slot can open to the edge of the fastener by a narrow slit, and the webbing can be slipped in and out of the slit. Instead of neoprene, the elastic cord can be made of other materials, or it can be a conventional shock cord covered with rubber. The cord can be made of non-elastic material. The cord can be attached to the hook in other ways, such as by cementing, crimping, etc. The free end of the cord can be anchored in other ways, such as with a clip, or by tucking it under itself or knoting it. The gap can be eliminated, so that the poles are threaded through the internal opening, instead of being snapped in. Therefore, the reader is requested to determine the scope of the invention by the appended claims and their legal equivalents, and not by the examples given.

I claim:

1. An assembly comprising:

a sheet of flexible material, at least one pole of a predetermined cross-sectional size, a fastener for fastening said sheet of flexible material to said pole, said fastener comprising:

a clip of solid material having (a) an opening of a predetermined size for receiving said pole in said opening, and (b) holding means for attaching said clip to said sheet of flexible material, and an elongated cord having opposite ends, one end of said cord being attached to said clip and an opposite end of said cord being free, said cord being long enough so that when said pole is positioned in said opening of said clip, said cord can be wrapped around said pole and said free end of said cord can be attached to said clip to securely attach said clip to said pole to positively prevent said sheet of flexible material and said pole from shifting with respect to each other, whereby said fastener can be used to securely fasten said sheet of flexible material and said pole together in a rapid, convenient, facile, and economical manner.

2. The assembly of claim 1 wherein said cord is long enough to be wrapped around said pole a plurality of times.

3. The assembly of claim 1 wherein said clip is made of plastic and is C-shaped.

4. The assembly of claim 1 wherein said cord is elastic.

5. The assembly of claim 1, further including anchoring means on said clip for anchoring said free end of said cord, after said cord is wrapped completely around said pole, to said clip so as to maintain said cord in tension.

6. The assembly of claim 5 wherein said anchoring means comprises an anchoring notch on said clip, said anchoring notch being sized for snugly receiving and anchoring said free end of said cord.

7. An assembly comprising:

a sheet of flexible tent membrane material, a pair of tent poles which cross at an intersection portion, said intersection portion having a predetermined cross-sectional size, a fastener for fastening said sheet of flexible tent membrane material to said pair of tent poles, said fastener comprising:

a clip of solid material having an opening of a predetermined size sufficient to receive said intersection portion of said tent poles within said opening, said clip containing holding means for holding said sheet of flexible tent membrane material, an elongated cord having opposite ends, one end of said cord being attached to said clip and an opposite end of said cord being free, so that when said poles are positioned within said opening of said clip, said cord can be wrapped completely around said poles at said intersection portion and said free end of said cord can be attached to said clip to securely attach said clip to said poles to positively prevent said sheet of flexible material and said poles from shifting with respect to each other, whereby said fastener can be used to securely fasten said sheet of flexible material and said poles together in a rapid, convenient, facile, and economical manner.

8. The assembly of claim 7 wherein said clip is made of plastic material and is C-shaped.

9. The assembly of claim 7, wherein said cord is elastic.

10. The assembly of claim 7, further including anchoring means on said clip for anchoring said free end of said cord to said clip.

11. The assembly of claim 10 wherein said anchoring means comprises an anchoring notch on said clip, said anchoring means being sized for snugly receiving and anchoring said free end of said cord.

12. The assembly of claim 10 wherein said cord is elastic and said anchoring means maintains said cord in tension.

13. An assembly comprising:

a pair of crossing tent poles which have an intersection portion of a predetermined size, a sheet of flexible tent material, and a fastener comprising:

a generally C-shaped solid clip having an opening of a predetermined size, and two ends forming a gap therebetween adjacent said opening, said gap being sized to allow said intersection portion of said pair of crossing tent poles to pass through said gap into said opening, said C-shaped solid clip including holding means for attaching said clip to said sheet of flexible tent material, a cord having opposite ends, one end being attached to said clip, said cord being long enough and an opposite end being free so that said cord can be wrapped completely around said intersection portion of said tent poles when said tent poles are positioned in said opening and said free end of said cord can be attached to said clip to securely attach said clip to said poles to positively prevent said sheet of flexible material and said poles from shifting with respect to each other, whereby said fastener can be used to securely fasten said sheet of flexible tent material to said tent poles at said intersection portion, and also securely fasten said tent poles to each other, so as to positively prevent said sheet of flexible tent material and said tent poles from shifting with respect to each other.

14. The assembly of claim 13, further including anchoring means on said clip for anchoring said free end of said cord to said clip.

15. The assembly of claim 14 wherein said anchoring means comprises an anchoring notch on said C-shaped clip, said notch being sized for snugly receiving and anchoring said free end of said cord.

16. The assembly of claim 13 wherein said cord is long enough to be wrapped around said poles a plurality of times.

17. The assembly of claim 13 wherein said holding means includes a web attaching said C-shaped clip to said sheet of flexible tent material.

18. The assembly of claim 13 wherein said holding means includes a slot on said C-shaped clip, said slot being sized to hold a loop of webbing extending from said sheet of flexible tent material.

19. A method of fastening a sheet of flexible tent material to a pair of tent poles which intersect at an intersecting portion, said intersecting portion having a predetermined cross-sectional size, comprising:

providing a clip of solid material having an opening of a predetermined size, said opening being sized to receive said intersecting portion of said tent poles within said opening, said clip containing holding means for holding said clip to said sheet of flexible material, providing an elongated cord having opposite ends, one end of said cord being attached to said clip, the rest of said cord being an extending portion which extends free from said clip, said extending portion having an opposite free end, inserting said intersecting portion of said pair of tent poles into said opening of said clip, wrapping said extending portion of said cord around said intersecting portion of said pair of tent poles so as to securely fasten said sheet of flexible material to said tent poles at said intersecting portion, and also to fasten securely said tent poles to each other, thereby to positively attach said sheet of flexible material to said tent poles to positively prevent said tent poles from shifting with respect to each other and with respect to said sheet of flexible material, and securing said free end of said cord to said clip to positively prevent said sheet of flexible material and said poles from shifting with respect to each other.

20. The method of claim 19 wherein said extending portion of said cord is wrapped around said intersecting portion of said pair of tent poles a plurality of times.

* * * * *